United States Patent [19]

Urrestarazu Borda

[11] Patent Number: 4,989,872

[45] Date of Patent: Feb. 5, 1991

[54] GAME OF ENTERTAINMENT

[76] Inventor: Rafael Urrestarazu Borda, Pº. Oriamendi, Bº Ayete, San Sebastián, Spain, 28009

[21] Appl. No.: 378,640

[22] Filed: Jul. 12, 1989

[30] Foreign Application Priority Data

Oct. 28, 1988 [ES] Spain ..... 8803198[U]

[51] Int. Cl.[5] ..... A63B 71/00; A63F 9/08

[52] U.S. Cl. ..... 273/139; 273/138 A; 273/153 S; 273/1 M; 273/153 R

[58] Field of Search ..... 273/139, 138 R, 138 A, 273/153 R, 153 S, 155, 1 M, 156

[56] References Cited

U.S. PATENT DOCUMENTS

| | | | |
|---|---|---|---|
| 3,679,212 | 7/1972 | Smith | 273/138 A |
| 4,805,910 | 2/1989 | Monticolombi et al. | 273/153 R |
| 4,877,406 | 10/1989 | Wilk | 273/153 S |
| 4,889,340 | 12/1989 | Greene | 273/153 S |

FOREIGN PATENT DOCUMENTS

| | | | |
|---|---|---|---|
| 3246974 | 6/1984 | Fed. Rep. of Germany | 273/153 S |

*Primary Examiner*—Edward M. Coven
*Assistant Examiner*—Valeria A. Szczepanik
*Attorney, Agent, or Firm*—Toren, McGeady & Associates

[57] ABSTRACT

A game of entertainment, designed and intended for the player to try to arrange a specific number of elements or counters used in the game in a determined order, which elements or counters are completely concealed within the structure of the game and are capable of becoming visible through a window once the player has guided these elements or counters to the window. Therefore, if the codes seen through this window correspond with those provided on certain elements or counters, a prize will be won.

6 Claims, 3 Drawing Sheets

GAME OF ENTERTAINMENT

BACKGROUND OF THE INVENTION

There are in existence innumerable types of games of entertainment, some based on the conventional puzzles, that is to say, in the ordered or correct arrangement of a series of elements used in the game, others based on the player's skill, and even other games based on the player's fate and constancy.

Referring to this latter type of games, that is, in which only fate, and sometimes intuition and naturally constancy, play a part, all of them lack interest since the player's intervention is minimum and he is never prompted to play the game itself.

DESCRIPTION OF THE INVENTION

The game of the invention has been designed for the player to be encouraged and, therefore, prompted to play it, with the purpose of trying to win the prize since, as mentioned in the paragraph corresponding to the object of the invention, the game in question grants a prize when the objective pursued has been achieved.

More specifically and structurally, the game of the invention is comprised of two hollow spheres, one housed inside the other, and interconnected by stiffening separators, between which two spheres there will, logically, be determined an annular space or chamber in which a plurality of elements, which will hereinafter be referred to as "counters", is arranged, which counters are provided with a code capable of being seen through a window made for such purpose in the outer sphere, a view which will logically be achieved when the counter is positioned in front of the said window.

This arrangement of the counter towards the window must be carried out by the player himself, for which purpose there is provided a positioner by means of which one of the counters is moved towards this window, the player logically not knowing which counter it is until the counter faces the window, to therethrough view the code of the said counter.

This positioner is guided along grooves, cracks or lines made randomly and capriciously on the surface of the outer sphere, in order that the positioner may slide along the grooves and randomly trap one of the counters provided with the code, to direct it towards the window at which the player will be able to view it.

The positioner is completed with a guide, on the basis of which it is displaced lengthwise and widthwise of the outer sphere. Further, there is provided a blocking element also operable by the player himself, so that once a counter is positioned in front of the viewing window, this counter may, if deemed fit by the player, be blocked in the position facing the window, to again attempt to search for another counter, the code of which should logically correspond with the previously said counter, and so on until five counters, according to the embodiment to be described, are visible through the window, all of them bearing the same code, whereupon the prize or objective will be achieved.

A prize may also be won by visualising four counters of another group having like numbers, or even three counters of other groups also having the same numbers. In any case, rules for playing the game, that is to say, for winning the prizes, as well as for distributing them will be fixed.

The counters which will be hollow and which will preferably have a cubical configuration will be provided at one of their faces with the corresponding code and the opposite face will be hollow, so that the base of the positioner may be inserted through this face, thereby enabling the counter to be pulled towards the viewing window.

The number of counters, also in accordance with an arbitrary and preferred embodiment, since both the code as well as the amount of counters, the sizes, etc. could be varied, will preferably be of 350, divided as follows:

1 group of 85 counters, all of which have different codes.

80 groups of two counters having like numbers.

20 groups of three counters having like numbers.

10 groups of four counters having like numbers.

1 group of five counters having like numbers.

With this combination of counters, when the five counters having like numbers of the latter mentioned group are obtained, the top prize will be won, whereas when four counters, for example from one of the ten groups, are obtained, a consolation prize will be won, and if three counters of the existing twenty groups are obtained, a smaller prize will be won.

What is important in the game is that it will incorporate a date which will correspond to the date considered as the expiration date. Hence, if the purchaser of the game achieves, prior to this date, any of the previously said objectives, that is, if he succeeds in visualising the five like counters through the window, or four counters of the ten different groups, or even three counters of the twenty groups, he would have won a prize which will be facilitated to him by the corresponding company. However, if the player has not won any prize or achieved any combination, once this date on the game has elapsed, the game will have no right to a prize even though he achieves his objective subsequently.

DESCRIPTION OF THE DRAWINGS

To complete the aforegoing description and for a better understanding of the characteristics of the invention, a set of drawings is accompanied, forming an integral part thereof, in which merely by way of illustration and not limiting the following is represented.

PREFERRED EMBODIMENT OF THE INVENTION

Figure 1:
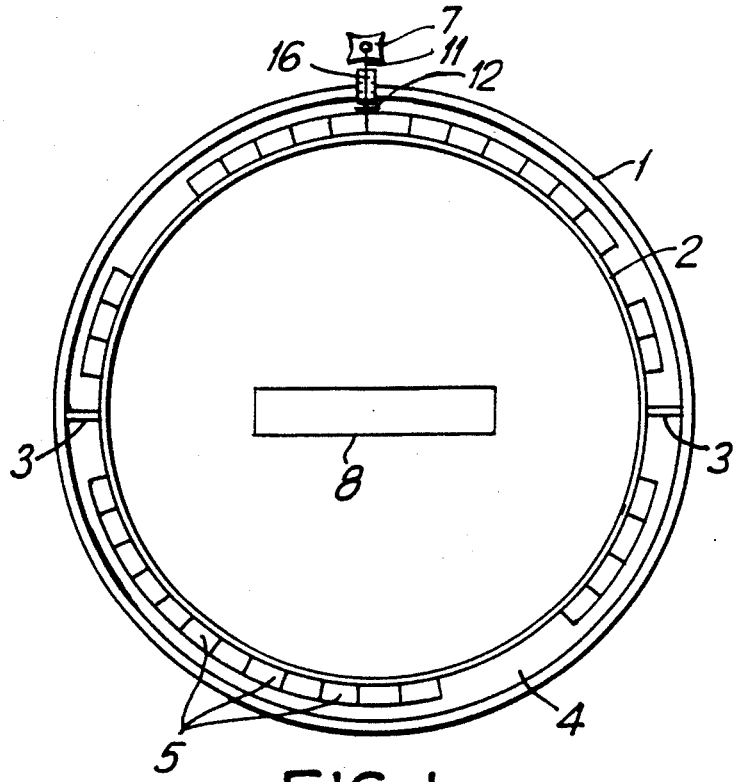
FIG. 1 illustrates a general view of the two spheres forming the game, along with counters housed in the space comprised between these two spheres, as well as the viewing window of the outer sphere and the positioner for the displacement of each of the counters towards the viewing window.

Referring to the drawings, it can be seen that the game of the invention is comprised of two spheres 1 and 2, this latter being housed inside the former concentrically. Both spheres are joined and separated from each other by means of rigid separators 3. Between both spheres 1 and 2 there is determined an annular space or chamber 4 in which a plurality of counters 5 is housed, which counters are all alike but each one has an identifying code, as will be explained later on.

The outer sphere 1 is provided with a plurality of grooves or lines 6 constituting paths or courses for a positioner 7 capable of pulling the counters 5 towards a viewing window 8 made in the said outer sphere 1, on a zone 9 of which there will be engraved a date considered as the expiry date of the game, to which the corresponding reference will also be made.

Figure 4:
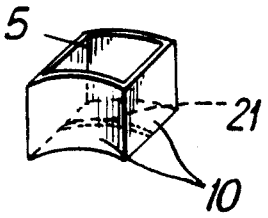
FIG. 4 illustrates a perspective view of one of the counters bearing its code on the lower face thereof.

The hollow counters 5, which will preferably have a cubical configuration, will not be provided with their upper base, whilst the lower base thereof will be provided with a code 10, as illustrated in FIG. 4, a code which may include ten or twelve numbers and which will be divided into groups of five or six, depending on the case. The base of the said counters 5 will incorporate a metal layer which will be completed with another provided in the inner sphere 2, which layers will be magnetised so that the counters 5 may rest on the outer surface of the said inner sphere 2, as illustrated in FIG. 1.

The counters 5, as already indicated, are trapped by a positioner 7 and pulled towards the window 8, through which the codes of this counter will be seen.

Figure 5:
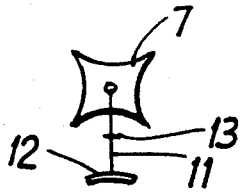
FIG. 5 illustrates a general view of the positioner provided with a gripping handle, a base opposite the same and a joining element of both.
Figure 6:
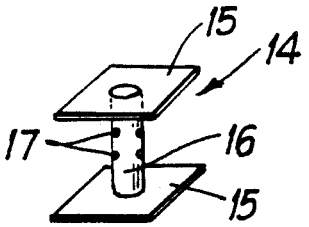
FIG. 6 illustrates the guide element of the positioner represented in the preceding figure.
Figure 7:
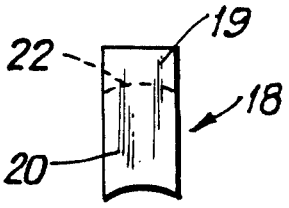
FIG. 7 illustrates a general view of the blocking element for locking a counter when it is in a position facing the viewing window of the outer sphere.

The positioner 7 will be formed of a handle, corresponding precisely to that referenced 7 in FIG. 5, from which a rod 11 emerges. To the other end thereof is affixed a plate 12 which is introduced through the open base of the counter 5 to enable pulling thereof. The rod 11 is further provided with a position fixer 13, on the basis of which the general positioner 7 may adopt three different vertical positions, a lower, an intermediate and an upper. Thus, there is provided a guide element 14 formed of two end parallel plates 15 joined together by a tubular portion 16 in which the rod 11 of the positioner 7 is housed, which tubular portion 16 is provided with means for blocking the fixer 13 of the positioner 7 at any one of the previously mentioned positions. These means are referenced with 17 in the guide element 14 itself represented in FIG. 6.

Consequently, this guide element 14 will be provided with a tubular portion 16 housed in any of the grooves 6 of the outer sphere. One of the plates 15 will remain outside of the sphere and the other will remain on the inside thereof, whilst the rod 11 of the positioner will be housed in the tubular portion 16 of the guide element 14, with the plate 12 thereof inwards and the handle 7 outwards. This assembly is duly mounted to enable the positioner 7 to be fixed at any one of the already mentioned positions and to permit the plate 12 thereof to be inserted through the open base of one of the counters 5 and to pull this counter to the viewing window 8.

Once the code or number of the said counter has been seen, the player may decide to maintain it blocked at this position in order to try to achieve other like counters, or to leave it and try to achieve counters of other groups. Thus, in the first case, the blocking of the counter, with the purpose of permanently viewing it through the window 8, is achieved with a blocking element 18 formed of an upper part 19 outside of the sphere 1 and an inner part 20. This blocking element 18 will be introduced through a groove 21 made for such purpose in the base of the counter 5, whilst the part 19 protrudes from the blocking element, which part, in the event the counter is to be permanently blocked, will be cut at the tear line 22 with which the blocking element 18 is provided.

Figure 8:
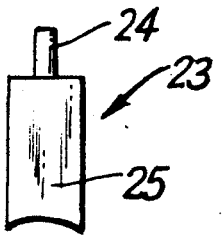
FIG. 8 illustrates an element constituting a position corrector of the counter pulled by the positioner illustrated in FIG. 5.
Figure 9:
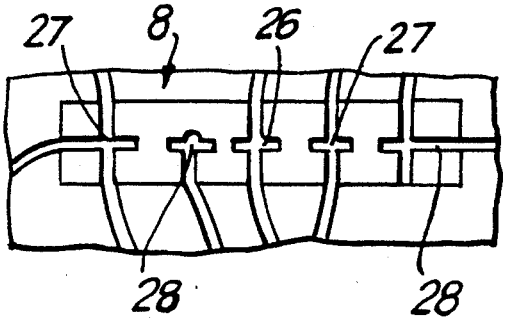
FIG. 9 illustrates a detailed view of the five windows provided in the outer sphere, through which as many counters, or in other words, the number or code thereof, will be seen.

If the counter reaches the window 8 and it is not well positioned, there is incorporated a correcting element 23, illustrated in FIG. 8, provided with a gripping handle 24 and a part 25 which will be introduced through a slot 26 provided in the window. The five parts of the window, since it has to permit the viewing of five correlative counters, are represented in FIG. 9, each part being provided with recesses 27 which are totally open or partly open according to reference 28.

Figure 10:
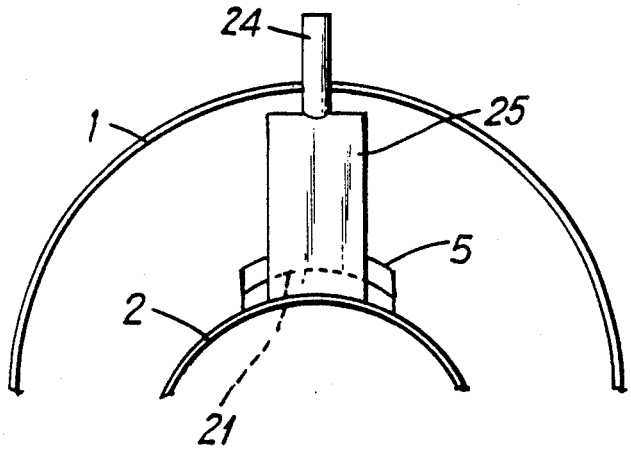
FIG. 10 illustrates an enlarged view of the arrangement of the correcting element assembled between the two spheres comprising the game and acting on a counter which has finally been positioned correctly.
Figure 11:
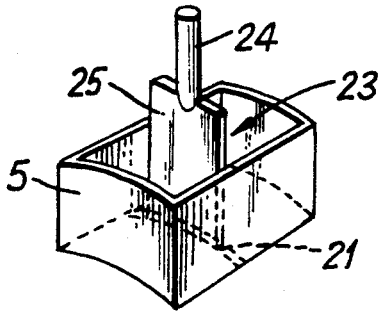
FIG. 11 illustrates a detailed view of the corrector represented in FIGS. 8 and 10, at the initiation position for correcting the position of a badly placed counter.
Figure 12:
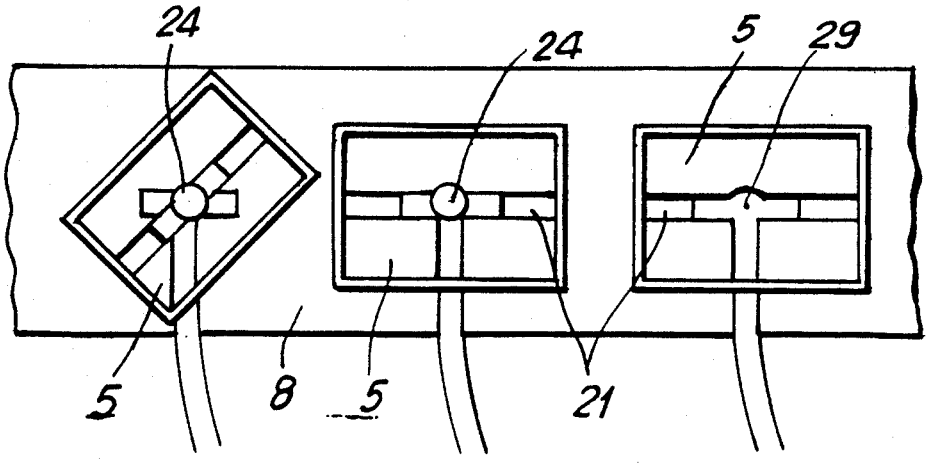
FIG. 12 illustrates the operative phases of the corrector for positioning a counter from an incorrect position to a correct position, always in correspondence with the viewing window.

FIGS. 10 and 11 likewise illustrate the same correcting element 23 in an assembly phase, that is to say, with its part 25 coupled in the slot 21 of the counter 5 for correctly positioning it, whilst FIG. 12 illustrates the correct positioning sequence or process of the counter 5. The left-hand side of this figure shows the counter positioned in a diagonal direction with respect to the longitudinal of the window 8, whilst the two right-hand positions represent the counter correctly arranged on this viewing window 8, the correcting element 23 acting in all cases on the said counter 5, showing its corresponding slot 21 for housing the part 25 of the element 23 as well as the hole 29 in the window 8 itself for enabling the perfect operation and turn of the correcting element 23.

In accordance with the described structure, the game is designed so that the player may apply, to the utmost, the three principle factors at the time of accomplishing the pursued objective, that is to say, good luck, intuition and constancy. This game merely involves an initial disbursement, that of purchasing the product, and then the player will have a fixed term, which will be marked by the expiry date engraved on the zone 9 of the outer sphere, to win any one of the three prizes allotted by this game, in accordance with one of the many existing alternatives, since it has been mentioned throughout this specification that the player may succeed in viewing the five counters forming a group having like numbers through the windows, thereby winning the top prize, or he could achieve four like counters of a group of one of the ten groups of counters having like numbers existing in the interior, or he could view three like counters of one of the twenty groups having like numbers which are also included between both spheres, or the existing eighty groups of two counters having like numbers and one group of eighty-five counters all having different codes, the game including a total of three hundred and fifty cards.

One of the main characteristics of this game is that each person acquiring it will have a different code at the time of achieving the pursued five numbers or counters, as well as the four and three, respectively, which will also win a prize. In this manner, the game is proportioned with a rather personal touch and, therefore, different in each case.

Another important characterstic is that of the expiry date. This means that if at this date the objective has not been accomplished, that is to say, a group of five, four or three codes has not been formed, the player will no longer have the option or right to any prize, even though he could achieve such code subsequent to this date.

Both the combination of the counters as well as the number thereof, even the number of groups and the manner in which the prizes are given, etc., have been given by way of example, although it is obvious that all these conditions could be varied in accordance with the rules and regulations laid down at that moment.

Figure 2:
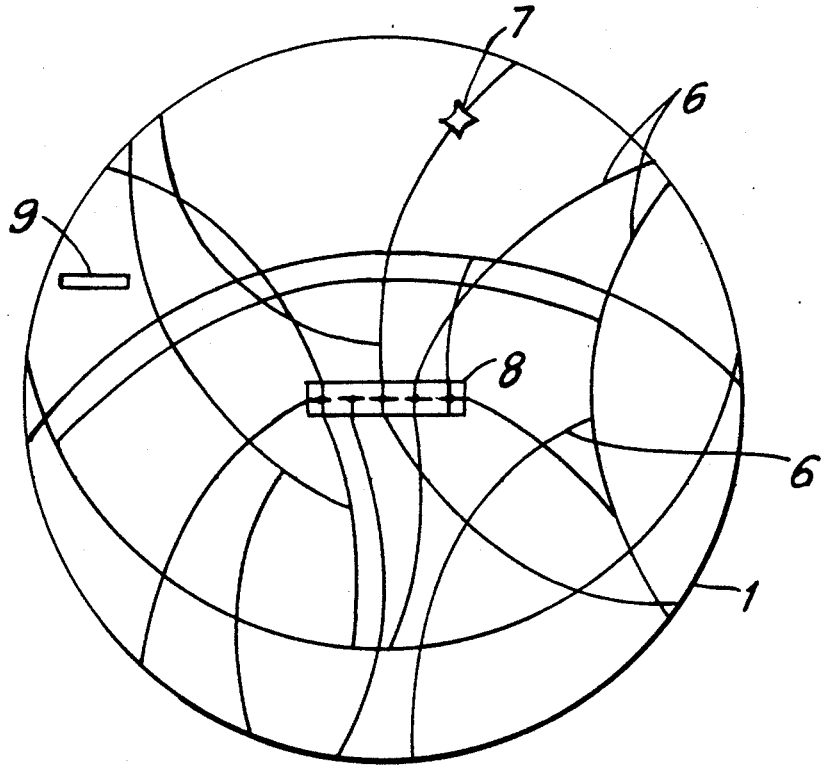
FIG. 2 illustrates an external view of the game, that is, of the outer sphere provided with grooves for the displacement of the positioner, which grooves are capriciously made; this figure illustrates the positioner arranged on one of these grooves, the viewing window and the date considered as the expiry date.
Figure 3:
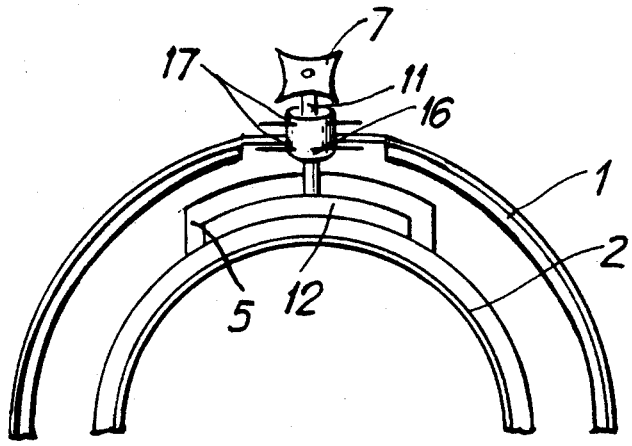
FIG. 3 illustrates an assembly detail of the positioner trapping a counter.

Finally, it must be stated that the windows generally referenced with 8, according to FIG. 9, are made in such a manner that the positioner can reach them through different routes, as can clearly be seen in FIG. 2 and in FIG. 9 itself.

It is not considered necessary to further extend this description so that any person skilled in the art may understand the scope of the invention and the advantages derived therefrom.

The materials, shape, form and arrangement of the elements could be varied, provided that the essential features of the invention are not modified.

The terms in which this specification has been described should be regarded in a broad rather than a restrictive sense.

I claim:

1. A game of entertainment, comprising:

two spheres, arranged one inside the other;

rigid separators provided between said spheres so as to separate and form a chamber between said spheres;

a plurality of cubically shaped counters housed in said chamber, each of said counters having an open side and an another side provided with a numeric code, the outer sphere being fluted by a random arrangement of grooves, said grooves determining paths toward a window divided into five equal parts and provided in an outer one of said spheres; and a positioner slidable along said grooves and formed so as to be able to trap one of said counters and move said one counter toward said window, an arrangement in said window of five of said counters having a common code determining accomplishment of a final objective.

2. A game of entertainment according to claim 1, wherein the face of said counters having the code is provided with a slot, and is formed of a metal sheet which is complimentary to an additional metal sheet provided on an outer side surface of the inner sphere, both said sheets being magnetized so that said counters can rest on the surface of the inner sphere.

3. A game of entertainment according to claim 1, wherein the positioner comprises a rod having one end which is provided with a manually actuatable handle, and another end provided with a plate which is introduced through the open side of said counters so as to allow pulling thereof, the rod being provided with a fixing element, said fixing element comprising a tubular portion which joins an upper plate and a lower plate, the tubular portion and the two plates forming a guide element for the positioner, the guide element being arranged so that the upper plate is outside and the inner plate is inside of the outer sphere, the rod of the positioner being housable in the tubular portion during displacement of the positioner along the grooves forming the paths in the outer sphere.

4. A game of entertainment according to claim 2, and further comprising a blocking element for locking desired counters on the window, said blocking element having an inner part which is housable in the groove on the side of a corresponding counter and a protruding, outer gripping part separable from the inner part of the blocking element by a tear line so that said blocking element along with the corresponding counter are lockable at a desired position.

5. A game of entertainment according to claim 1, and further comprising a correcting element for positioning the counter correctly on the window, the correcting element having a protruding portion so as to be grippable, and an internal portion which is housable in the slot of the side of the counter so as to allow movement and positioning of the counter on the window.

6. A game of entertainment according to claim 1, wherein the outer sphere is provided with indicia representing a game expiration date.

* * * * *